US011627790B2

(12) United States Patent
Fereyre et al.

(10) Patent No.: US 11,627,790 B2
(45) Date of Patent: Apr. 18, 2023

(54) STEAM HAIR STYLING APPLIANCE

(71) Applicant: SEB S.A., Ecully (FR)

(72) Inventors: Régis Fereyre, Lyons (FR); Johan Sabattier, Mornant (FR); Nicolas Lauchet, Estrablin (FR)

(73) Assignee: SEB S.A.

( * ) Notice: Subject to any disclaimer, the term of this patent is extended or adjusted under 35 U.S.C. 154(b) by 1078 days.

(21) Appl. No.: 16/315,092

(22) PCT Filed: Jul. 4, 2017

(86) PCT No.: PCT/FR2017/051822

§ 371 (c)(1),
(2) Date: Jul. 3, 2019

(87) PCT Pub. No.: WO2018/007753

PCT Pub. Date: Jan. 11, 2018

(65) Prior Publication Data

US 2019/0313759 A1 Oct. 17, 2019

(30) Foreign Application Priority Data

Jul. 6, 2016 (FR) ..... 1656505

(51) Int. Cl.
*A45D 1/04* (2006.01)
*A45D 1/00* (2006.01)

(52) U.S. Cl.
CPC ..... *A45D 1/04* (2013.01); *A45D 2001/008* (2013.01)

(58) Field of Classification Search
CPC ..... A45D 1/04; A45D 2001/008; A45D 7/02
See application file for complete search history.

(56) References Cited

U.S. PATENT DOCUMENTS 3,934,114 A 1/1976 Godel et al.
6,802,320 B2 * 10/2004 Janouch ..... A45D 2/36 392/386

(Continued)

FOREIGN PATENT DOCUMENTS

CN 201911498 U 8/2011
WO WO 98/4351 A1 10/1998

(Continued)

OTHER PUBLICATIONS

International Search Report dated in International Patent Application No. PCT/FR2017/051822, dated Sep. 22, 2017.

(Continued)

*Primary Examiner* — Nicholas D Lucchesi
*Assistant Examiner* — Jennifer Gill
(74) *Attorney, Agent, or Firm* — Lerner David LLP

(57) ABSTRACT

A hair-styling appliance includes a first and second arm pivotably mounted between a spaced-apart and a closed configuration; a reservoir mounted on the first arm and intended for containing a fluid to be vaporised; a vaporisation device mounted on the first arm and configured for generating vapour; a fluid-conveying element attached to the reservoir and configured for conveying fluid contained in the reservoir to the vaporisation device. The reservoir is movably mounted between a vaporisation position in which the vaporisation device is configured for vaporising the fluid conveyed by the fluid conveying element and an inoperative position. The hair-styling appliance includes an actuating element mounted on the second arm and configured for moving the reservoir from the inoperative position to the vaporisation position when the first and second arms are moved from the spaced-apart configuration to the closed configuration.

12 Claims, 5 Drawing Sheets

Fig. 6

Fig. 5

(56) References Cited

U.S. PATENT DOCUMENTS

| | | | | |
|---|---|---|---|---|
| 7,325,551 | B2 * | 2/2008 | Henninger | A45D 1/02 132/228 |
| 7,478,640 | B2 | 1/2009 | Saida et al. | |
| 2004/0003824 | A1 | 1/2004 | Habibi | |
| 2004/0244810 | A1 | 12/2004 | Henninger et al. | |
| 2006/0108344 | A1 * | 5/2006 | Kim | A45D 20/50 392/379 |
| 2008/0283081 | A1 | 11/2008 | Habibi | |
| 2012/0272993 | A1 * | 11/2012 | Fereyre | A45D 6/00 132/221 |
| 2012/0312320 | A1 | 12/2012 | Humphreys et al. | |
| 2013/0192625 | A1 * | 8/2013 | Migliori | A45D 1/28 132/211 |
| 2014/0166038 | A1 | 6/2014 | Leung | |
| 2015/0289622 | A1 * | 10/2015 | Fereyre | A45D 1/04 132/211 |
| 2017/0006988 | A1 * | 1/2017 | Wong | A45D 1/04 |

FOREIGN PATENT DOCUMENTS

| | | | |
|---|---|---|---|
| WO | WO 2014/064660 | A1 | 5/2014 |
| WO | WO 2015/097628 | A1 | 7/2015 |

OTHER PUBLICATIONS

U.S. Appl. No. 16/315,077, filed Sep. 6, 2019, titled "Steam Hairstyling Device Having a Mobile Fluid Reservoir".

* cited by examiner

STEAM HAIR STYLING APPLIANCE

CROSS-REFERENCE TO RELATED APPLICATIONS

This application is the U.S. National Stage of PCT/FR2017/051822, filed Jul. 4, 2017, which in turn claims priority to French Patent Application No. 1656505 filed Jul. 6, 2016, the entire contents of all applications are incorporated herein by reference in their entireties.

This invention concerns a hair styling appliance, and more specifically a portable steam hair styling appliance intended to treat the hair with vaporization in order to shape it. In addition to steaming the hair, a hair styling appliance is generally configured to heat the hair in order to shape it.

The document U.S. Pat. No. 7,478,640 discloses a hair styling appliance comprising in particular:

- a first arm and a second arm comprising respectively a first contact surface and a second contact surface, the first and second arms being mounted to be articulated with respect to each other between an open position in which the first and second contact surfaces are spaced apart from each other and a strand of hair is able to be introduced between the first and second contact surfaces, and a closed configuration in which the first and second contact surfaces are close to each other and are able to clamp a strand of hair,
- a reservoir mounted on the first arm, the reservoir being intended to contain a fluid to be vaporized,
- a vaporization device mounted on the first arm and configured to produce steam,
- a fluid conveyor element secured to the reservoir and configured to convey the fluid contained in the reservoir towards the vaporization device, and
- a steam diffusion device configured to diffuse the steam produced by the vaporization device towards the exterior of the hair styling appliance and close to the first contact surface.

In a known manner, the vaporization device is activated by the movement of the first and second arms towards their closed configuration. Thus, such a hair styling appliance further comprises in particular a detection element, such as a reed switch magnetic sensor, or a magnetoresistive sensor (MRS), configured to detect the closed configuration of the first and second arms, and a control unit configured to control the activation of the vaporization device, and more particularly of a heating element belonging to the vaporization device, when the detection element detects the closed configuration of the first and second arms.

However, such a configuration of the hair styling appliance requires a complex and precise definition of the fluid conveyor element and of the vaporization device in order to ensure a satisfactory steam flow, increasing the costs of manufacturing such a hair styling appliance. In addition, such a configuration of the hair styling appliance may cause an accumulation of fluid in the vaporization chamber of the vaporization device, and thus harm the functioning or even the integrity of the hair styling appliance.

This invention aims to remedy these disadvantages.

The technical problem at the basis of the invention thus consists of providing a hair styling appliance with a simple, reliable and economical structure, while ensuring a satisfactory steam flow.

To this end, this invention concerns a hair styling appliance comprising at least:

- a first arm and a second arm comprising respectively a first contact surface and a second contact surface, the first and second arms being mounted to be articulated with respect to each other between an open configuration in which the first and second contact surfaces are spaced apart from each other and a strand of hair is able to be introduced between the first and second contact surfaces, and a closed configuration in which the first and second contact surfaces are close to each other and are able to clamp a strand of hair,
- a reservoir mounted on the first arm and intended to contain a fluid to be vaporized,
- a vaporization device mounted on the first arm and configured to produce steam, and
- a fluid conveyor element secured to the reservoir and configured to convey the fluid contained in the reservoir towards the vaporization device, characterized in that the reservoir is mounted such that it can move between a resting position in which the fluid conveyor element is away from the vaporization device, and a vaporization position in which the fluid conveyor element is close to the vaporization device and the vaporization device is configured to vaporize the fluid conveyed by the fluid conveyor element, and in that the hair styling appliance further comprises an actuating element configured to move the reservoir from the resting position to the vaporization position when the first and second arms are moved from the open configuration to the closed configuration.

The invention thus remarkably permits automatically moving the reservoir from its resting position to its vaporization position when the first and second arms move from their open configuration towards their closed configuration.

Such a configuration of the hair styling appliance permits separating the fluid conveyor element from the vaporization device when the first and second arms are in the open configuration, and thus avoiding an accumulation of fluid in particular in the vaporization chamber of the vaporization device.

In addition, such a configuration of the hair styling appliance, and in particular of the actuating element, ensures that it is easy to move the reservoir towards its vaporization position without necessitating a particular action by the user. In other words, the movement of the reservoir is thus performed automatically.

In this way, the hair styling appliance according to this invention is more reliable than the hair styling appliances from the prior art, while being just as easy to use.

The hair styling appliance may in addition have one or more of the following characteristics, taken alone or in combination.

According to one embodiment of the invention, the fluid to be vaporized intended to be contained in the reservoir is water or an aqueous cosmetic product, such as a cosmetic product diluted in water.

According to one embodiment of the invention, the actuating element is mounted on the second arm.

According to one embodiment of the invention, the actuating element comprises a cam surface configured to cooperate with the reservoir.

According to one embodiment of the invention, the cam surface has a continuous curved profile. Such a configuration of the cam surface permits in particular the actuating element to apply a more constant force on the reservoir, and thus improves the performances of the hair styling appliance.

According to one embodiment of the invention, the cam surface comprises a series of cam surface portions, the cam surface portions having different bend radii. In the event of wear of the fluid conveyor element, such a configuration of the cam surface permits increasing the movement path of the reservoir towards its vaporization position when the first and second arms move towards the closed configuration, and thus keeping substantially constant pressure exerted by the vaporization device on the fluid conveyor element when the first and second arms are in the closed configuration. These provisions thus permit maintaining a substantially constant steam flow over time, and thus maintaining the performance level of the hair styling appliance in spite of the wear of the fluid conveyor element.

According to one embodiment of the invention, the cam surface is configured such that each cam surface portion has a bend radius larger than the bend radius of the cam surface portion preceding it.

According to one embodiment of the invention, the cam surface is an involute of a circle.

According to one embodiment of the invention, the actuating element is mounted such that it can pivot, for example on the first arm, around a pivoting axis, the hair styling appliance further comprising a biasing element configured to bias the actuating element towards an actuation position in which the actuating element is able to exert pushing force on the reservoir. These provisions ensure an optimal steam flow, and thus an optimal performance level of the hair styling appliance, in spite of the manufacturing tolerances in particular of the first and second arms, of the reservoir, of the fluid conveyor element and of the actuating element, which could harm satisfactory cooperation between the fluid conveyor element and the vaporization device. These provisions also permit not being dependent on the bearing force exerted by the user on the first and second arms, and thus ensure a substantially constant flow regardless of the effort exerted by the user on the first and second arms.

According to one embodiment of the invention, the cam surface is at least partially formed of an ellipsoidal surface portion.

According to one embodiment of the invention, the fluid conveyor element is configured to be in contact with the vaporization device when the reservoir is in the vaporization position.

According to one embodiment of the invention, the vaporization device comprises a vaporization surface. Advantageously, the fluid conveyor element is configured to be in contact with the vaporization surface when the reservoir is in the vaporization position.

According to one embodiment of the invention, the fluid conveyor element is a wick.

According to one embodiment of the invention, the fluid conveyor element is of absorbent material.

According to one embodiment of the invention, the fluid conveyor element is of non-woven fibers.

The fluid conveyor element may, for example, be made of polyethylene terephthalate, of polyethylene or of a mixture of polyethylene terephthalate and polyethylene.

According to one embodiment of the invention, the fluid conveyor element comprises a first portion extending into the reservoir and intended to be in contact with the fluid to be vaporized contained in the reservoir, and a second portion extending to the exterior of the reservoir.

According to one embodiment of the invention, the reservoir comprises an outlet opening, the fluid conveyor element extending through the outlet opening.

According to one embodiment of the invention, the fluid conveyor element is secured to the outlet opening of the reservoir. According to one embodiment of the invention, the reservoir is removably mounted on the first arm.

According to one embodiment of the invention, the first arm comprises a housing in which the reservoir is mounted, a through opening leading to the housing and intended for the passage of the reservoir, and a closure element mounted such that it can move, and for example pivot on the first arm between an open position in which the closure element at least partially releases the through opening and permits the reservoir to be removed or mounted in the housing, and a closed position in which the closure element at least partially closes the through opening and prevents the reservoir from being removed or mounted in the housing.

According to one embodiment of the invention, the reservoir is mounted such that it can move in translation with respect to the first arm.

According to one embodiment of the invention, the reservoir is mounted such that it can move with respect to the first arm according to a displacement direction substantially parallel to the direction of extension of the first arm.

According to one embodiment of the invention, the hair styling appliance comprises at least one return element configured to return the reservoir to the resting position.

According to one embodiment of the invention, the vaporization device comprises a vaporization chamber in which the fluid conveyor element is at least partially arranged when the reservoir is in the vaporization position.

Advantageously, the vaporization surface at least partially delimits the vaporization chamber.

According to one embodiment of the invention, the vaporization device comprises a heating element. The heating element may, for example, be a resistive element.

According to one embodiment of the invention, at least one of the first and second arms comprises a heating plate, which may, for example, be substantially flat.

According to one embodiment of the invention, the first and second arms comprise respectively a first heating plate and a second heating plate. The first and second heating plates then advantageously define the first and second contact surfaces.

According to one embodiment of the invention, the reservoir is elongated and comprises a first extremity portion situated on the vaporization device side and a second extremity portion opposite the first extremity portion, the actuating element being configured to cooperate with the second extremity portion of the reservoir.

According to one embodiment of the invention, the reservoir extends globally along one extension direction.

According to one embodiment of the invention, the reservoir comprises a reservoir portion intended to contain the fluid to be vaporized, and a holding portion secured to the reservoir portion, the holding portion being configured to hold the fluid conveyor element. The holding portion may, for example, be secured by screwing onto the reservoir portion.

According to one embodiment of the invention, the holding portion delimits the outlet opening.

According to one embodiment of the invention, the hair styling appliance further comprises a steam diffusion device configured to diffuse the steam produced by the vaporization device towards the exterior of the hair styling appliance. The steam diffusion device may also be configured to diffuse the steam produced by the vaporization device close to the first contact surface. "Close to the first contact surface" is understood to mean in particular adjacent to the first contact surface or at the level of the first contact surface.

According to one embodiment of the invention, the steam diffusion device is configured to diffuse the steam towards the second contact surface, when the first and second arms are in the closed configuration.

According to one embodiment of the invention, the steam diffusion device comprises at least one diffusion opening fluidically connected to the vaporization device, and for example to the vaporization chamber, the at least one diffusion opening being configured to diffuse the steam produced by the vaporization device towards the exterior of the hair styling appliance and close to the first contact surface.

According to one embodiment of the invention, the first contact surface comprises a groove with a bottom, the at least one diffusion opening leading to the bottom of the groove.

According to one embodiment of the invention, the steam diffusion device comprises a plurality of diffusion openings.

According to one embodiment of the invention, the diffusion openings are distributed along the groove.

At any rate, the invention will be understood with the assistance of the following description in reference to the attached schematic drawings representing, as non-restrictive examples, several forms of execution of this hair styling appliance.

FIGS. 1 to 7 represent a hair styling appliance 2 according to a first embodiment of the invention, and more particularly a hair straightener.

Figure 1:
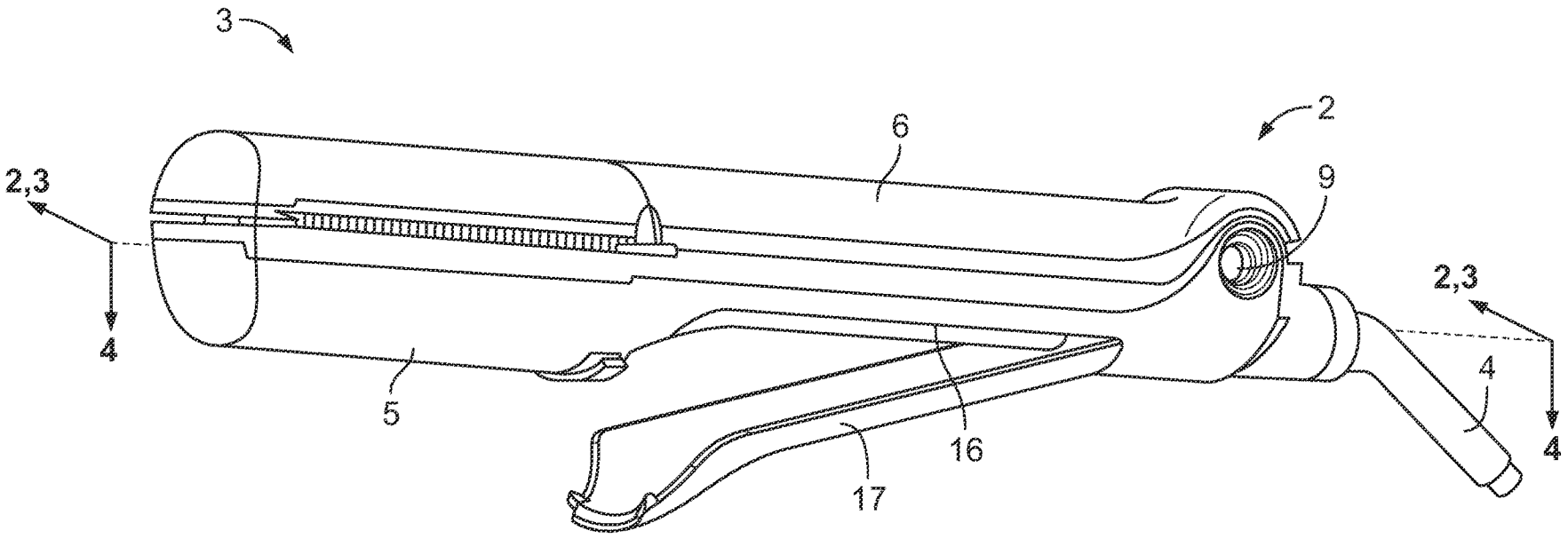
FIG. 1 is a perspective view of a hair styling appliance according to a first embodiment of the invention.
Figure 2:
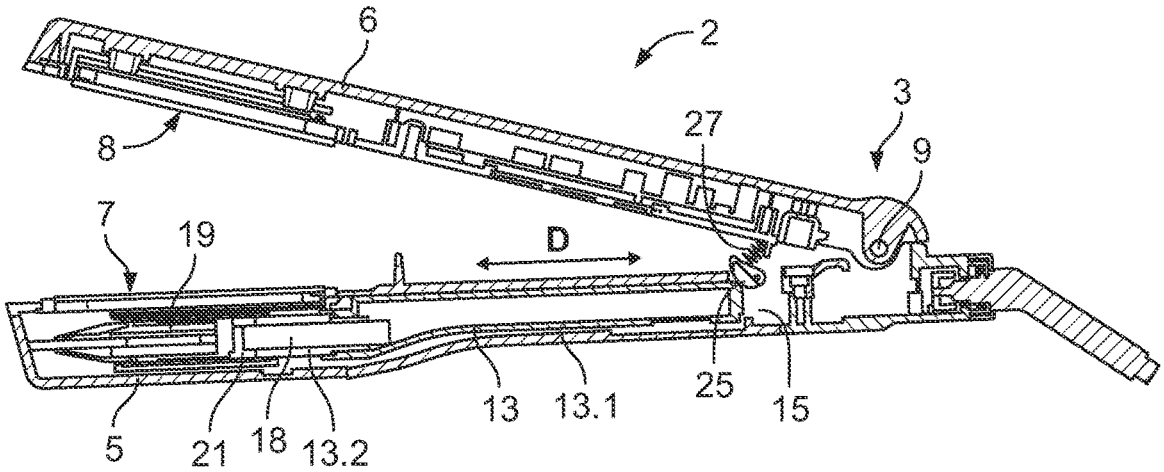
FIG. 2 is a longitudinal cross-section view of the hair styling appliance in FIG. 1, in which the arms of the hair styling appliance are in an open configuration.
Figure 3:
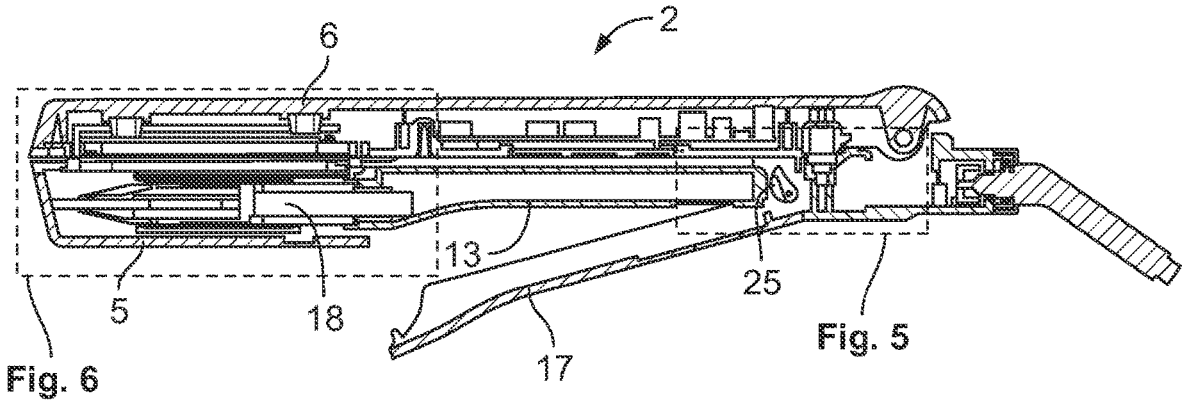
FIG. 3 is a longitudinal cross-section view of the hair styling appliance in FIG. 1, in which the arms of the hair styling appliance are in a closed configuration.
Figure 4:
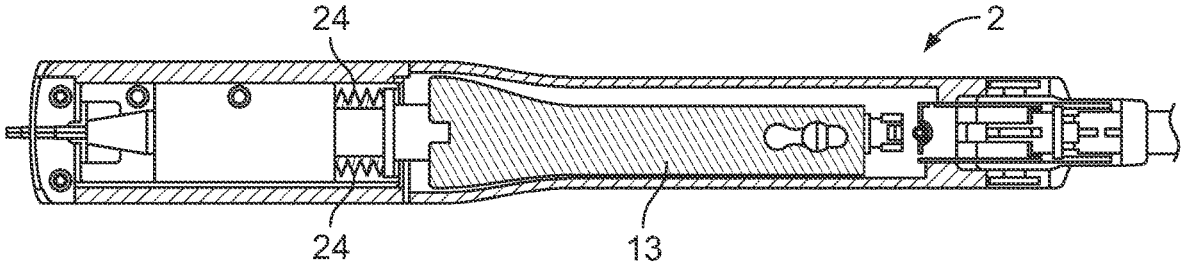
FIG. 4 is a longitudinal cross-section view of the hair styling appliance in FIG. 1, showing more particularly return means configured to return the reservoir to a resting position.
Figure 5:
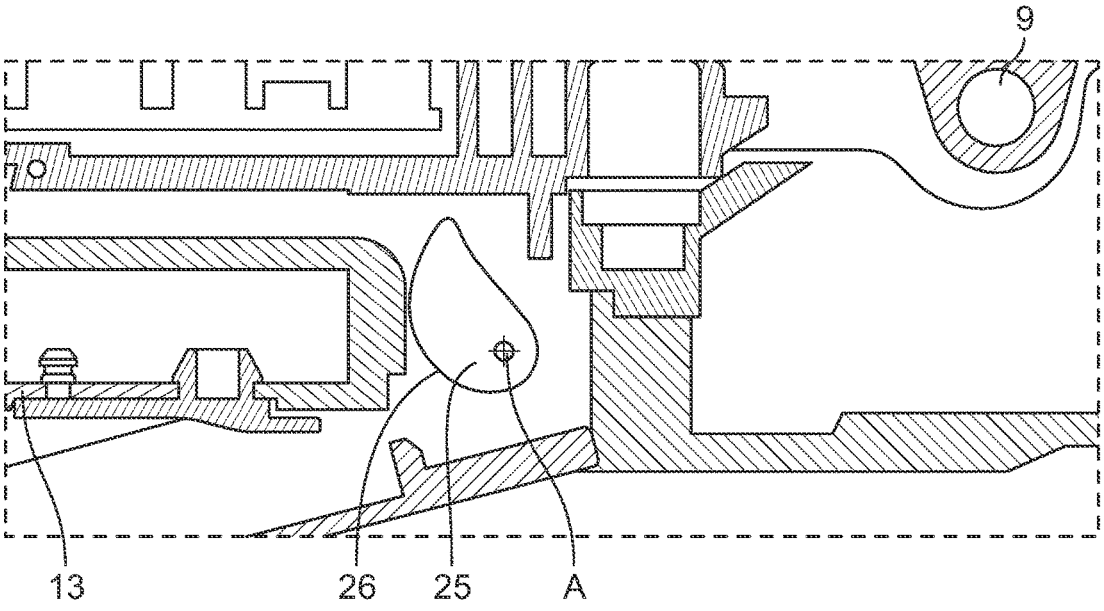
FIG. 5 is a scaled-up view of a detail in FIG. 3.

The hair styling appliance 2 comprises a portable treatment unit 3, which may advantageously be electrically powered by an electrical connecting cable 4.

The portable treatment unit 3 comprises a first arm 5 and a second arm 6, also called jaws, comprising respectively a first contact surface 7 and a second contact surface 8. The first and second arms 5, 6 are more particularly mounted to be articulated with respect to each other by means of a pivoting link 9 and between an open configuration in which the first and second contact surfaces 7, 8 are spaced apart from each other and a strand of hair is able to be introduced between the first and second contact surfaces, and a closed configuration in which the first and second contact surfaces 7, 8 are close to each other and are able to clamp a strand of hair.

According to the embodiment represented in FIGS. 1 to 7, the first and second contact surfaces 7, 8 are flat, and the first and second arms 5, 6 comprise respectively a first heating plate 11 and a second heating plate 12 (shown more particularly in FIG. 7) which respectively define the first and second contact surfaces 7, 8. Nevertheless, according to an embodiment variant of the hair styling appliance, only one of the first and second arms 5, 6 could be equipped with a heating plate, and at least one of the first and second contact surfaces 7, 8 could be curved or waw in order to permit, for example, curling or crimping of the hair strands introduced between the first and second contact surfaces 7, 8.

The portable treatment unit 3 further comprises heating means configured to heat the first and second heating plates 11, 12. These heating means are not described in detail in this patent application because they are well known to the person skilled in the art. These heating means may, for example, comprise a first heating device (not represented in the figures) arranged in the first arm 5 and a second heating device (not represented in the figures) arranged in the second arm 6. Each of the first and second heating devices may, for example, comprise a positive temperature coefficient thermistor (PTC).

The portable treatment unit 3 also comprises a reservoir 13 intended to contain a fluid to be vaporized, such as water or an aqueous cosmetic product. According to the embodiment represented in FIGS. 1 to 7, the reservoir 13 is elongated and extends globally along one extension direction. Nevertheless, the reservoir 13 may have a different form without departing from the context of this invention. In addition, according to one embodiment of the invention, the reservoir 13 comprises a reservoir portion 13.1 intended to contain the fluid to be vaporized, and a holding portion 13.2 secured to the reservoir portion 13.1 and delimiting an outlet opening 14. The holding portion 13.2 may, for example, be secured by screwing onto the reservoir portion 13.1.

According to the embodiment represented in FIGS. 1 to 7, the reservoir 13 is removably mounted in a housing 15 provided in the first arm 5. Advantageously, the first arm 5 comprises a through opening 16 leading to the housing 15 and intended for the passage of the reservoir 13, and a closure element 17, such as a closing shutter, mounted such that it can pivot on the first arm 5 between an open position in which the closure element 17 at least partially releases the through opening 16 and permits the reservoir 13 to be removed or mounted in the housing 15, and a closed position in which the closure element 17 at least partially closes the through opening 16 and prevents the reservoir 13 from being removed or mounted in the housing 15.

The portable treatment unit 3 further comprises a fluid conveyor element 18 secured to the reservoir 13, and more particularly to the holding portion 13.2, and extending through the outlet opening 14 of the reservoir 13. The fluid conveyor element 18 is configured to convey the fluid contained in the reservoir 13 towards the exterior of the reservoir. According to the embodiment represented in FIGS. 1 to 7, the fluid conveyor element 18 is a wick of absorbent material, and comprises a first portion extending into the reservoir 13 and intended to be in contact with the fluid to be vaporized contained in the reservoir 13, and a second portion extending to the exterior of the reservoir 13. The fluid conveyor element 18 may, for example, be made of non-woven fibers, and be made of polyethylene terephthalate, of polyethylene or of a mixture of polyethylene terephthalate and polyethylene. Nevertheless, the fluid conveyor element 18 could also be made of any other appropriate material.

Figure 6:
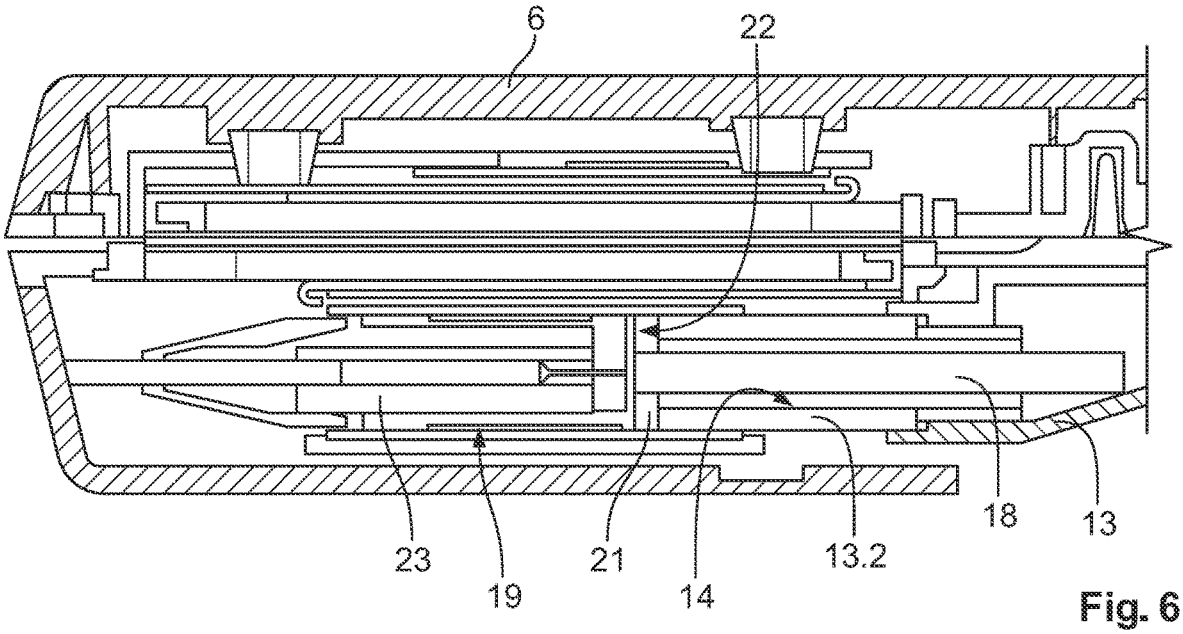
FIG. 6 is a scaled-up view of a detail in FIG. 3.
Figure 7:
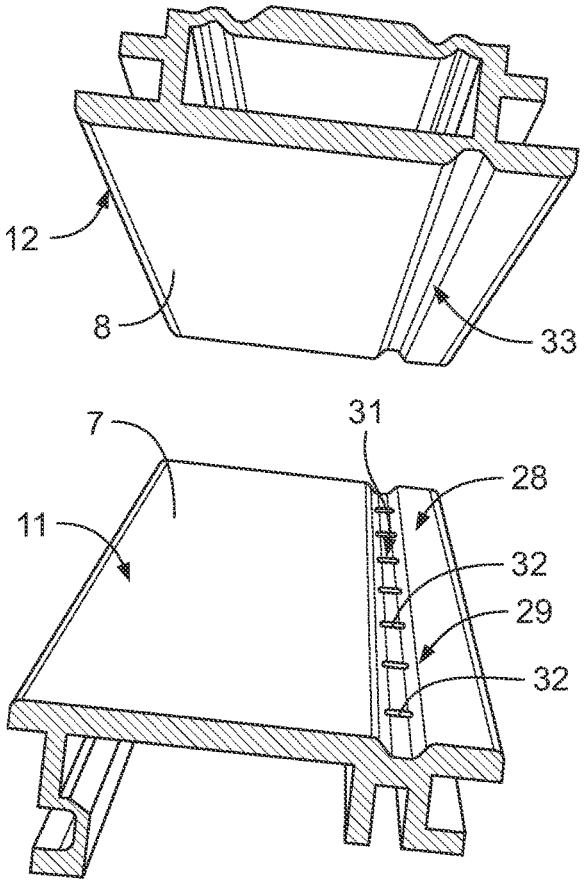
FIG. 7 is a perspective view of the heating plates of the hair styling appliance in FIG. 1.

As shown in FIG. 6, the portable treatment unit 3 also comprises a vaporization device 19 mounted on the first arm 5, and configured to produce steam. The vaporization device 19 more particularly comprises a vaporization chamber 21 in which the fluid conveyor element 18 is at least partially arranged when the reservoir 13 is in the vaporization position. The vaporization device 19 further comprises a vaporization surface 22 partially delimiting the vaporization chamber 21, and a heating element 23 configured to heat the vaporization surface 22. The heating element 23 may, for example, be a resistive element, such as a positive temperature coefficient thermistor (PTC).

The reservoir 13 is more particularly mounted such that it can move according to a displacement direction D between a resting position (see FIG. 2) in which the fluid conveyor element 18 is away from the vaporization surface 22, and a vaporization position (see FIG. 6) in which the fluid conveyor element 18 is close to the vaporization surface 22, and, for example, in contact with the vaporization surface 22, and the vaporization device 19 is configured to vaporize the fluid conveyed by the fluid conveyor element 18. Advantageously, the displacement direction D of the reservoir 13 is substantially parallel to the extension direction of the first arm 5. It should be noted that the portable treatment unit 3 advantageously comprises one or more return elements 24 (see FIG. 4) configured to return the reservoir 13 to the resting position. The or each return element 24 may, for example be formed by a helical spring.

The portable treatment unit 3 further comprises an actuating element 25 mounted on the second arm 5, and configured to move the reservoir 13 from the resting position to the vaporization position when the first and second arms 5, 6 are moved from the open configuration to the closed configuration. The actuating element 25 comprises a cam surface 26 configured to cooperate with the reservoir 13, and more particularly with an extremity portion of the reservoir 13 opposite the vaporization device 19.

According to the embodiment represented on FIGS. 1 to 7, the cam surface 26 has a continuous curved profile, and comprises a series of cam surface portions having different bend radii. The cam surface 26 is more particularly configured such that each cam surface portion has a bend radius larger than the bend radius of the cam surface portion preceding it. According to this embodiment, the cam surface 26 is substantially an involute of a circle.

In addition, according to the embodiment represented in FIGS. 1 to 7, the actuating element 25 is mounted such that it can pivot on the first arm 5 around a pivoting axis A, and the portable treatment unit 3 further comprises a biasing element 27, such as a compression spring or a torsion spring, configured to bias the actuating element 25 towards an actuation position in which the actuating element 25 is able to exert pushing force on the reservoir 13. The biasing element 27 is more particularly configured to bias in rotation the actuating element 25 so as to separate the cam surface extremity 26, opposite the pivoting axis A, from the second arm 6.

Such a configuration of the cam surface 26 allows the actuating element 25 to apply a more constant force on the reservoir 13 when the first and second arms 5, 6 are moved in the closed configuration, and thus improves the performances of the hair styling appliance 2. In addition, in the event of wear of the fluid conveyor element 18, such a configuration of the cam surface 26 permits increasing the movement path of the reservoir 13 towards its vaporization position, and thus keeps the pressure exerted by the vaporization device 19 on the fluid conveyor element 18 substantially constant over time when the first and second arms 5, 6 are in the closed configuration. As a result, the steam flow is kept substantially constant over time, in spite of the wear of the fluid conveyor element 18.

In addition, such a mounting of the actuating element 25 on the second arm 6 and the presence of the biasing element 27 make it possible to offset the manufacturing tolerances in particular of the first and second arms 5, 6 of the reservoir 13, of the fluid conveyor element 18 and of the actuating element 25, and thus to ensure an optimal steam flow, and thus an optimal performance level of the hair styling appliance 2. These provisions also permit not being dependent on the bearing force exerted by the user on the first and second arms 5, 6, and thus ensure a substantially constant flow regardless of the effort exerted by the user on the first and second arms 5, 6.

The portable treatment unit 3 further comprises a steam diffusion device 28 fluidically connected to the vaporization device 19, and configured to diffuse the steam produced by the vaporization device 19 at the first contact surface 7, and in particular towards the second contact surface 8, when the first and second arms 5, 6 are in the closed configuration.

According to the embodiment represented in FIGS. 1 to 7, the first contact surface 7 comprises a groove 29 with a bottom 31, and the steam diffusion device 28 comprises a plurality of diffusion openings 32 fluidically connected to the vaporization chamber 21, and leading to the bottom 31 of the groove 29. Advantageously, the diffusion openings 32 are regularly distributed along the groove 29. It should be noted that the second contact surface 8 can advantageously comprise a confinement groove 33 configured to be provided facing the groove 29 when the first and second arms 5, 6 are in the closed configuration, so as to confine the steam diffused by the diffusion openings 32.

Figure 8:
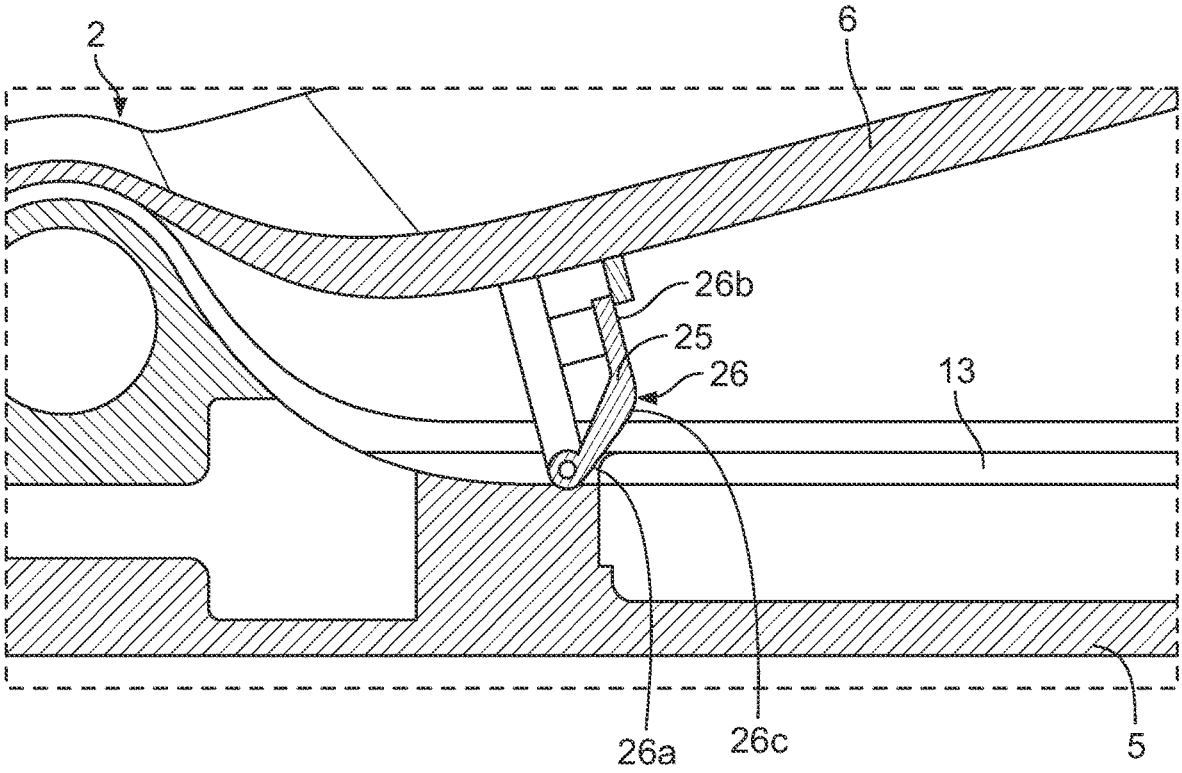
FIG. 8 is a partial cross-section view of a hair styling appliance according to a second embodiment of the invention.

FIG. 8 represents a hair styling appliance 2 according to a second embodiment of the invention which differs from the first embodiment essentially in that the cam surface 26 of the actuating element 25 comprises a first and a second surface portion 26*a*, 26*b* that are substantially flat and have different inclinations, and a rounded intermediate surface portion 26*c* arranged between the first and second surface portions 26*a*, 26*b*.

Figure 9:
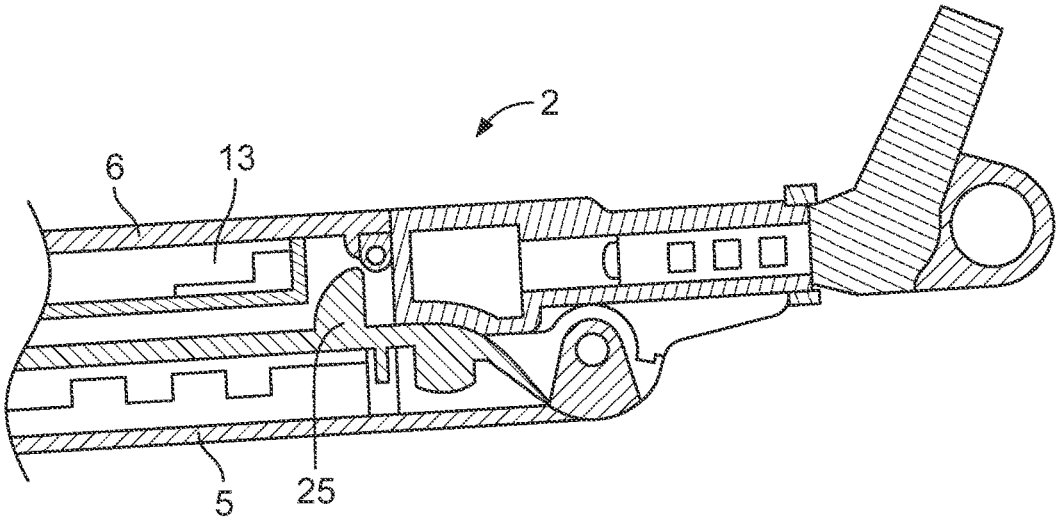
FIG. 9 is a partial cross-section view of a hair styling appliance according to a third embodiment of the invention.

FIG. 9 represents a hair styling appliance 2 according to a third embodiment of the invention which differs from the second embodiment essentially in that the actuating element 25 is fixedly mounted on the second arm 6.

As goes without saying, the invention is not limited only to the form of execution of this hair styling appliance, described above as an example; on the contrary, it encompasses all embodiment variants.

The invention claimed is:

1. A hair styling appliance comprising:

a first arm and a second arm comprising respectively a first contact surface and a second contact surface the first and second arms being mounted to be articulated with respect to each other between an open configuration in which the first and second contact surfaces are spaced apart from each other and a strand of hair is able to be introduced between the first and second contact surfaces and a closed configuration in which the first and second contact surfaces are close to each other and are able to clamp a strand of hair;

a reservoir mounted on the first arm and adapted to contain a fluid to be vaporized into steam;

a vaporization device mounted on the first arm and configured to produce the steam, and a fluid conveyor element secured to the reservoir and configured to convey the fluid contained in the reservoir towards the vaporization device, wherein the reservoir is mounted such that the reservoir is moveable between a resting position in which the fluid conveyor element is away from the vaporization device, and a vaporization position in which the fluid conveyor element is close to the vaporization device and the vaporization device is configured to vaporize the fluid conveyed by the fluid conveyor element and in that wherein the hair styling appliance further comprises an actuating element configured to automatically move the reservoir from the resting position to the vaporization position when the first and second arms are moved from the open configuration to the closed configuration, wherein the actuating element is configured to cooperate with the reservoir and is mounted on the second arm such that the actuating element is pivotable on the first arm around a pivoting axis, and wherein the actuating element comprises a cam surface configured to cooperate with the reservoir.

2. The hair styling appliance according to claim 1, wherein the cam surface has a continuous curved profile.

3. The hair styling appliance according to claim 2, wherein the cam surface comprises a series of cam surface portions, the cam surface portions having different bend radii.

4. The hair styling appliance according to claim 1, wherein the cam surface is an involute of a circle.

5. The hair styling appliance according to claim 1, the hair styling appliance further comprising a biasing element configured to bias the actuating element towards an actuation position in which the actuating element is able to exert pushing force on the reservoir.

6. The hair styling appliance according to claim 1, wherein the fluid conveyor element is a wick.

7. The hair styling appliance according to claim 1, wherein the reservoir is removably positioned on the first arm.

8. The hair styling appliance according to claim 7, wherein the first arm comprises a housing in which the reservoir is mounted, a through opening leading to the housing and intended for the passage of the reservoir and a closure element mounted such that the closure element is moveable on the first arm between an open position in which the closure element at least partially releases the through opening and permits the reservoir to be removed or mounted in the housing and a closed position in which the closure element at least partially closes the through opening and prevents the reservoir from being removed or mounted in the housing.

9. The hair styling appliance according to claim 1, further comprising at least one return element configured to return the reservoir to the resting position.

10. The hair styling appliance according to claim 1, wherein at least one of the first and second arms comprises a heating plate.

11. The hair styling appliance according to claim 1, wherein the reservoir is elongated and comprises a first extremity portion situated on the vaporization device side and a second extremity portion opposite the first extremity portion, the actuating element being configured to cooperate with the second extremity portion of the reservoir.

12. The hair styling appliance according to claim 1, further comprising a steam diffusion device configured to diffuse the steam produced by the vaporization device towards the exterior of the hair styling appliance.

* * * * *